US011738918B2

(12) United States Patent
Levitz

(10) Patent No.: US 11,738,918 B2
(45) Date of Patent: Aug. 29, 2023

(54) CHILD RESISTANT CONTAINER

(71) Applicant: Ben Levitz, St. Paul, MN (US)

(72) Inventor: Ben Levitz, St. Paul, MN (US)

(73) Assignee: Ben Levitz, St. Paul, MN (US)

( * ) Notice: Subject to any disclaimer, the term of this patent is extended or adjusted under 35 U.S.C. 154(b) by 504 days.

(21) Appl. No.: 17/072,536

(22) Filed: Oct. 16, 2020

(65) Prior Publication Data

US 2022/0119171 A1 Apr. 21, 2022

(51) Int. Cl.

*B65D 50/04* (2006.01)
*B65D 5/20* (2006.01)
*B65D 5/50* (2006.01)

(52) U.S. Cl.

CPC ..... *B65D 50/045* (2013.01); *B65D 5/20* (2013.01); *B65D 5/5038* (2013.01)

(58) Field of Classification Search

CPC .... B65D 50/045; B65D 50/046; B65D 50/04; B65D 50/00; B65D 5/20; B65D 5/503; B65D 5/5038; B65D 5/5035; B65D 5/38; B65D 5/728; B65D 7/06; B65D 7/10; B65D 9/08; B65D 11/12

See application file for complete search history.

(56) References Cited

U.S. PATENT DOCUMENTS 6,047,829 A * 4/2000 Johnstone ..... B65D 5/38 229/125.125
7,708,142 B2 * 5/2010 Ehrlund ..... B65D 5/38 206/528
7,845,496 B2 * 12/2010 Hession ..... B65D 83/0463 229/125.125
8,939,281 B2 * 1/2015 Matsuba ..... B65D 25/00 206/459.1
9,573,720 B2 * 2/2017 Dixon ..... B65D 5/0227
10,442,565 B2 * 10/2019 Mulvey ..... B65D 5/38
10,710,785 B2 * 7/2020 Patwardhan ..... B65D 5/38
2003/0047482 A1 * 3/2003 Jones ..... B65D 83/0463 206/534
2007/0054525 A1 * 3/2007 Jones ..... B65D 5/445 439/159
2009/0200332 A1 * 8/2009 Intini ..... B65D 83/0409 221/154

* cited by examiner

*Primary Examiner* — Javier A Pagan
(74) *Attorney, Agent, or Firm* — Glen E. Schumann; Moss & Barnett

(57) ABSTRACT

The present invention is a scalable, lockable container designed to prevent children from accessing the contents in the container. It includes an inner tray that is slidably mounted within an outer sleeve in releasable locking engagement. The lock mechanism includes a lock tab carried at one end of the inner tray that engages an engagement edge formed inside the outer sleeve. When so engaged, the inner tray is locked within the outer sleeve and cannot be removed from the outer sleeve. The lock tab is released by applying pressure to the outer sleeve, adjacent the lock tab, to disengage the lock tab from the engagement edge in the outer sleeve. This allows the lock tab to move past the outer sleeve engagement edge so the inner tray can be withdrawn from the outer sleeve, providing access to the contents of the box.

16 Claims, 21 Drawing Sheets

CHILD RESISTANT CONTAINER

FIELD OF THE INVENTION

The present invention relates to a secure, scalable, child proof container for dispensing products potentially harmful to children, such as medicines, liquid fuels, solvents, pesticides, household detergents, cleaning agents, maintenance and care products, and a special emphasis on *cannabis*.

BACKGROUND OF THE INVENTION

A significant number of suspected cases of ingestion by children of products used about the home are reported to the medical profession each year. Most are not serious and those that are associated with more serious side effects involve products known to be hazardous, e.g. certain medicinal products, liquid fuels and solvents, strongly acid or alkaline preparations and some garden products. Most commonly used household detergents, cleaning agents, and maintenance and care products are not known to have caused injury. However, whether ingestion (actual or suspected) causes injuries or not, such incidents can have traumatic effects on both the child and the parents.

The use of potentially hazardous agents in certain products is necessary to achieve effectiveness; consequently, steps must be taken to limit the occurrence of accidents. One approach has been to try to increase general awareness of hazards associated with various products. Nevertheless, proper labeling and information by the manufacturer is important for the safe use of products in the home.

Another approach has been the use of child-resistant packaging to put a physical barrier between the child and the hazardous product. However, many of the prior art solutions have been single purpose, such as medicine bottles, and are not readily scalable.

Therefore, there is a need for an inexpensive container that is scalable for use with a broader array of products.

PRIOR ART

Prior art containers, particularly those used for dispensing *cannabis*, include an inner tray mounted within an outer sleeve. Protrusions extending outward from the inner tray correspond to openings in the outer sleeve. When the inner tray protrusions align with the corresponding openings in the outer sleeve, the protrusions extend into the opening to lock the inner tray in a closed position. To open the container and withdraw the inner tray from the outer sleeve, the protrusions are pressed inward towards the tray until they will clear the edges of the outer sleeve openings, allowing the tray to be withdrawn from the outer sleeve.

The protrusions may extend from opposing sides of the tray (like "ears") or may extend from the bottom of tray to engage corresponding openings in the outer sleeve. These protrusions may be rigidly fixed to the inner tray or may be retractable into the inner tray.

These containers are disadvantageous in that they require a significant amount of die cutting of openings in the outer sleeve, which drives up the cost and makes the container more vulnerable to being torn open, and these containers must be hand assembled.

SUMMARY OF THE INVENTION

The present invention is a paper-based, scalable, lockable container designed to prevent children from accessing the contents. The invention requires no die cut openings, which makes the container more secure. Further, the inner tray and outer sleeve can be machine assembled.

The container of the present invention includes a sturdy inner tray that is slidably mounted within a flexible outer sleeve in releasable locking engagement. The lock mechanism to keep the inner tray in a closed position includes an engagement edge on the interior of the outer sleeve and a locking tab carried at one end of the inner tray. An edge of the inner tray locking tab engages the engagement edge formed on the interior of the outer sleeve when the inner tray is in the fully closed position, locking the inner tray in its closed position and preventing it from being withdrawn from the outer sleeve. Pressure is applied to the outer sleeve above the inner tray locking tab to cause the inner tray locking tab to disengage the engagement edge of the outer sleeve. This allows the locking tab to move past the engagement edge and the inner tray to be withdrawn from the outer sleeve, providing access to the contents of the box.

The inner tray and outer sleeve are machine foldable from blanks.

DETAILED DESCRIPTION OF THE INVENTION

Figure 4:
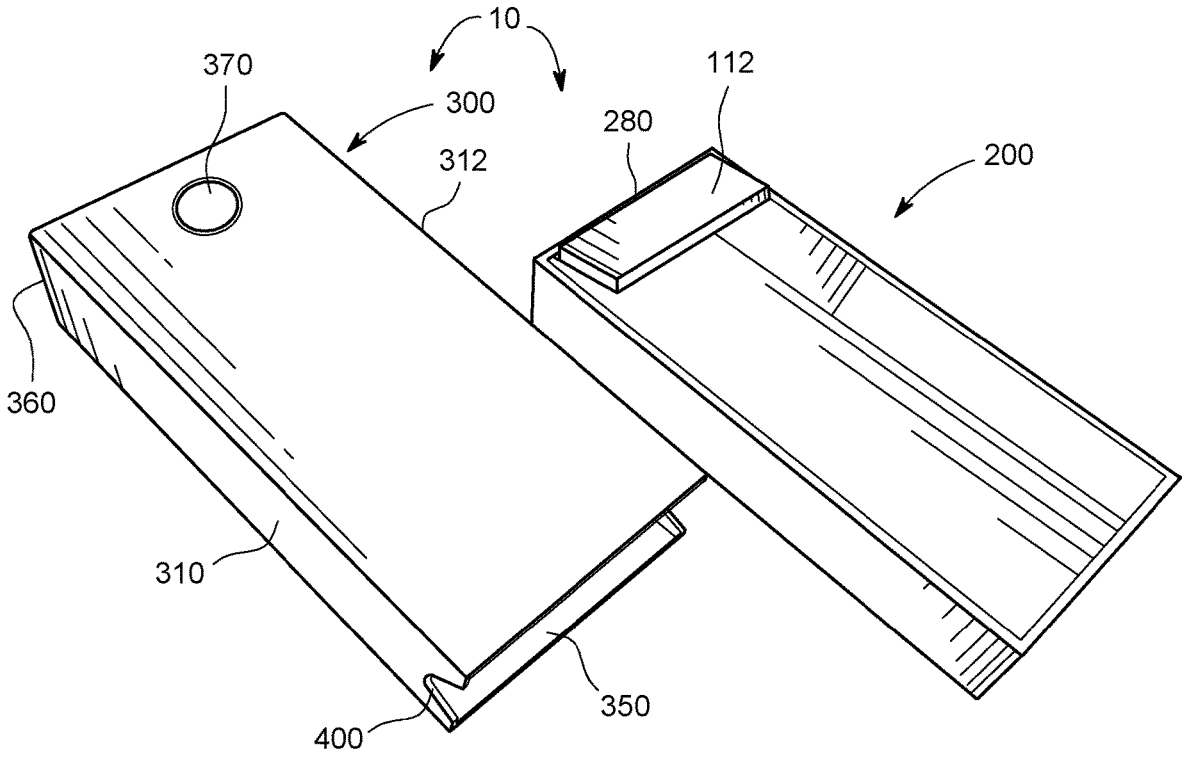
FIG. 4 is a perspective view of the assembled and wrapped inner tray and outer sleeve sitting next to each other.
Figure 5:
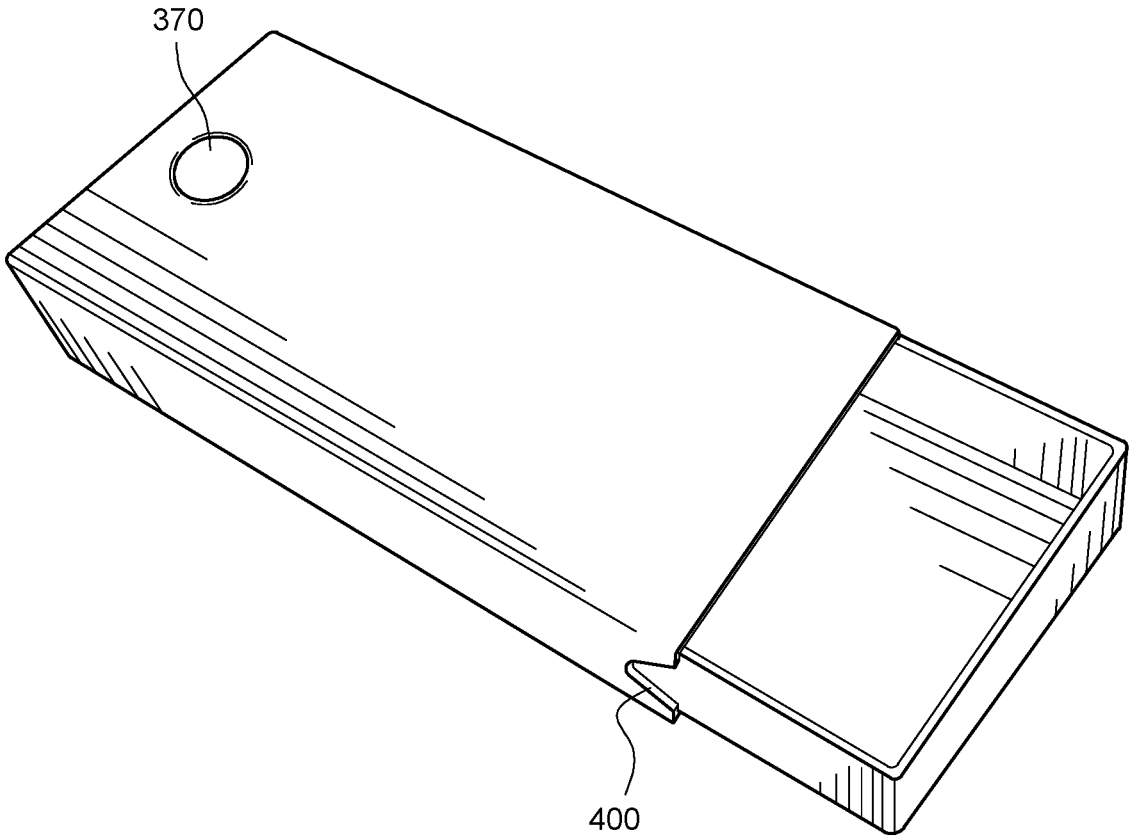
FIG. 5 is a perspective view of the assembled and wrapped inner tray slidably mounted within the outer sleeve, with the assembled and wrapped inner tray partially extended out of the outer sleeve.
Figure 6:
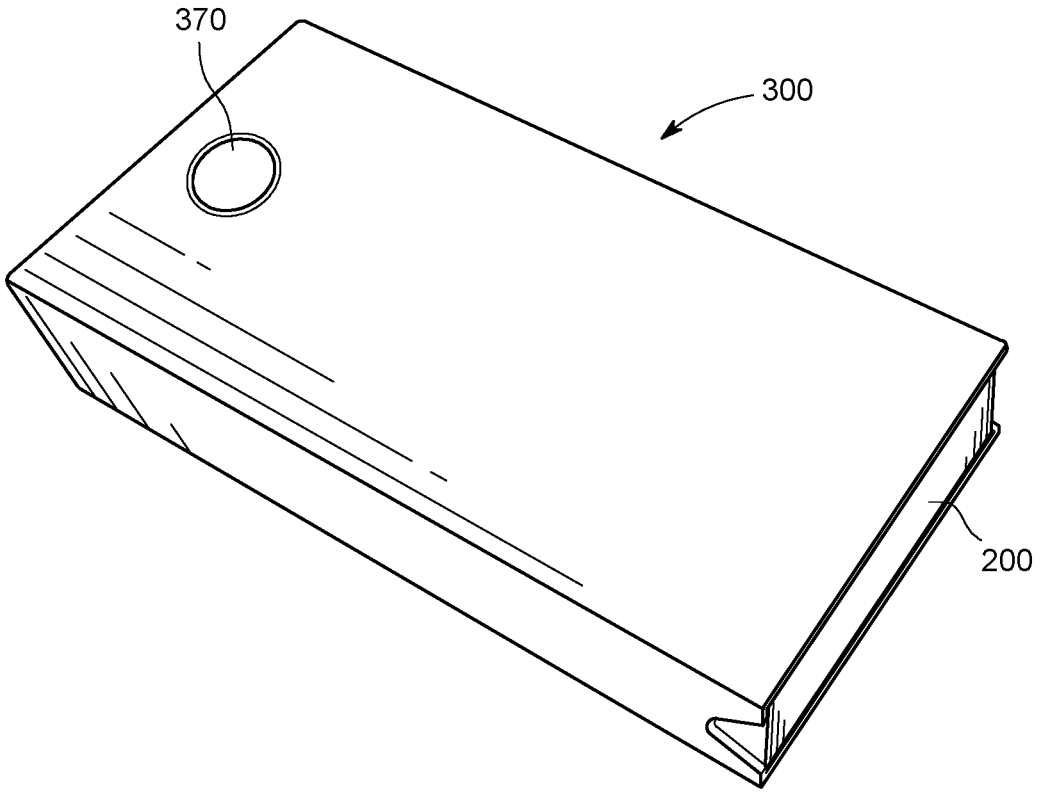
FIG. 6 is a perspective view of the assembled and wrapped inner tray slidably mounted within the outer sleeve, with the assembled and wrapped inner tray fully mounted within the outer sleeve.
Figure 7:
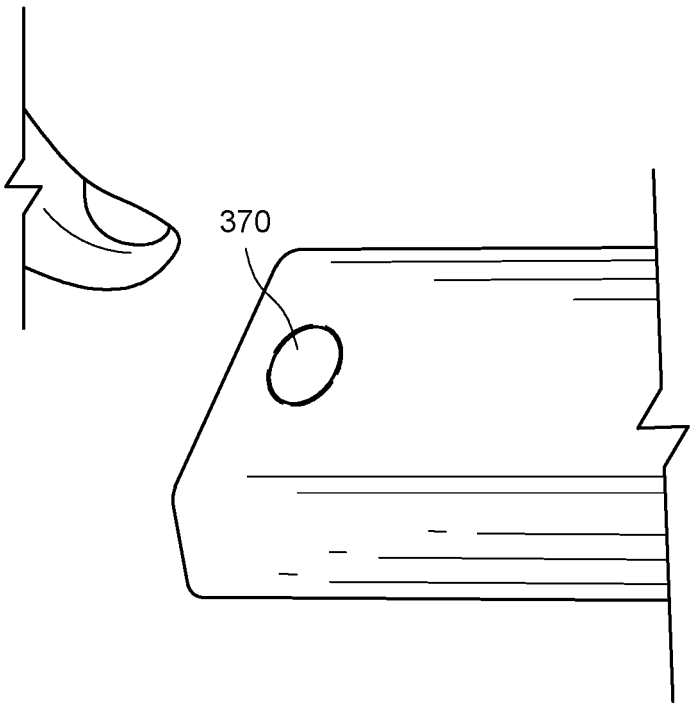
FIG. 7 is a perspective view of the outer sleeve, illustrating how the lock mechanism is unlocked.
Figure 8:
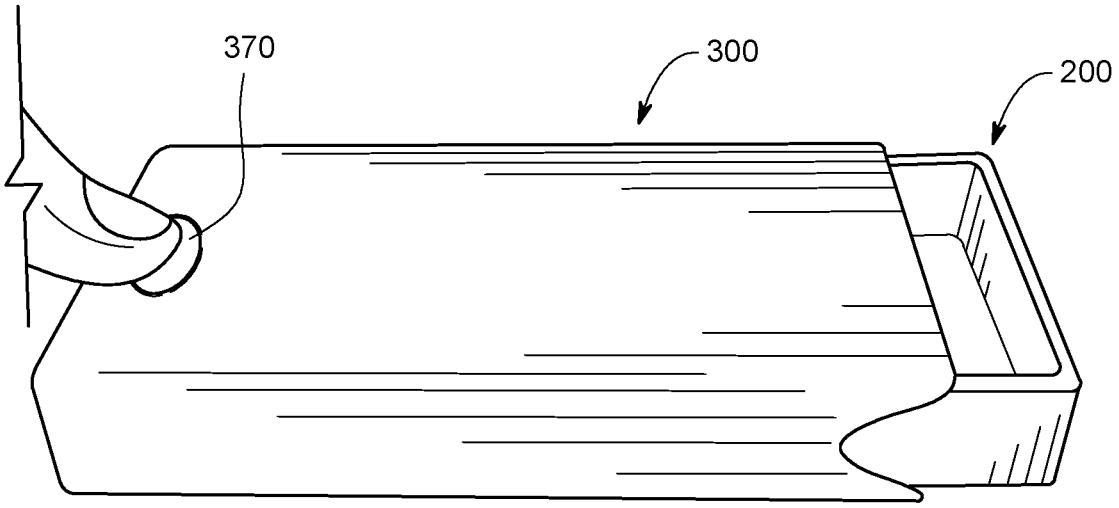
FIG. 8 is a perspective view of the outer sleeve, illustrating how the assembled and wrapped inner tray can be withdrawn from the outer sleeve after the lock mechanism has been released.

As best seen in FIG. 4, one embodiment of the present invention 10 includes a sturdy wrapped inner tray 200 and an outer folding carton sleeve ("outer sleeve") 300. Wrapped inner tray 200 includes an inner tray 100 enclosed by a wrapper 150. (See FIGS. 1 and 2.) Wrapped inner tray 200 is designed to hold contents and be slidably mounted within outer sleeve 300 in releasable interlocking relation.

In one preferred embodiment, the inner tray 100 is made of a sturdy paper product, such as cardboard, although other materials are anticipated by the present invention. An ideal material is one that is capable of being die cut, folded and yet having some resiliency along die cut lines. Ideally, the material is difficult to tear apart and is preferably liquid and/or chemical resistant. Wrapper 150 may be lighter or less thick material, such as a strong paper, and is preferably liquid and/or chemical resistant. Outer sleeve 300 may be a more flexible material, such as a flexible paperboard and is preferably liquid and/or chemical resistant. In one embodiment, the child resistant container is made from a 100% recyclable and biodegradable paper material and uses no plastic.

Figure 1:
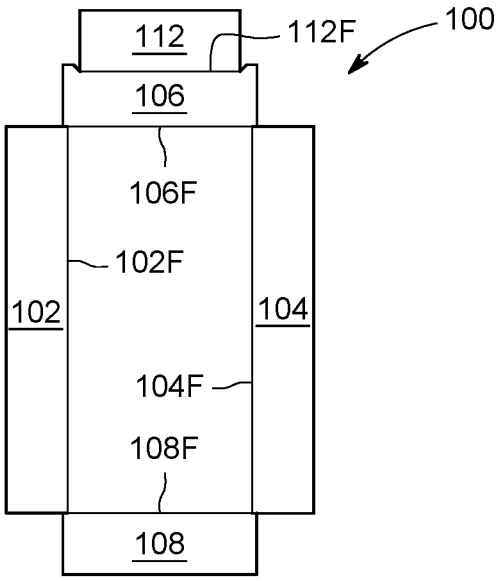
FIG. 1 is a top view of an inner tray blank before it is fully assembled.
Figure 1A:
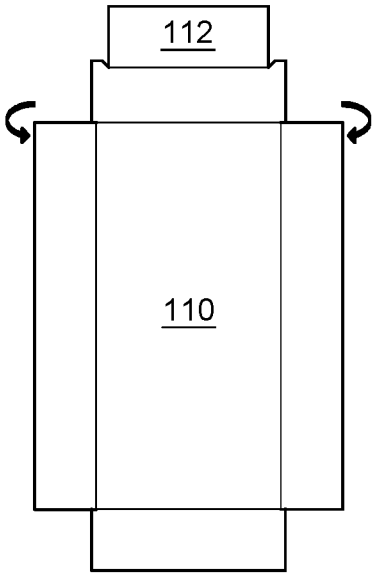
FIG. 1A is a top view of the inner tray blank identifying the first fold step to assembling the inner tray.
Figure 1B:
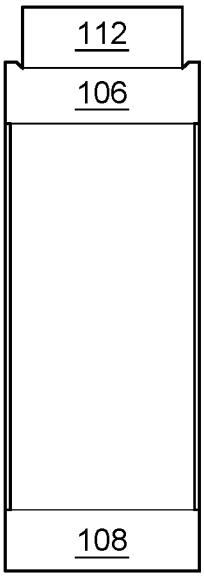
FIG. 1B is a top view of the inner tray blank illustrating completion of the first fold step to assembling the inner tray.
Figure 1C:
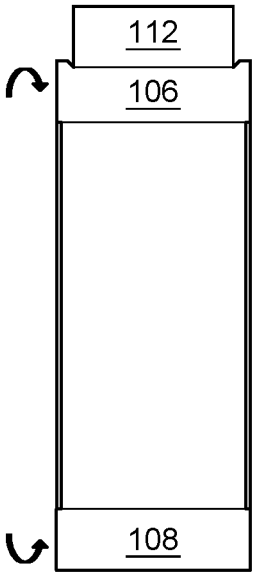
FIG. 1C is a top view of the inner tray blank identifying the second fold step to assembling the inner tray.
Figure 1D:
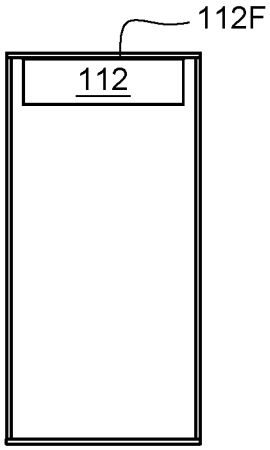
FIG. 1D is a top view of the inner tray blank illustrating completion of the second fold step to assembling the inner tray.
Figure 2:
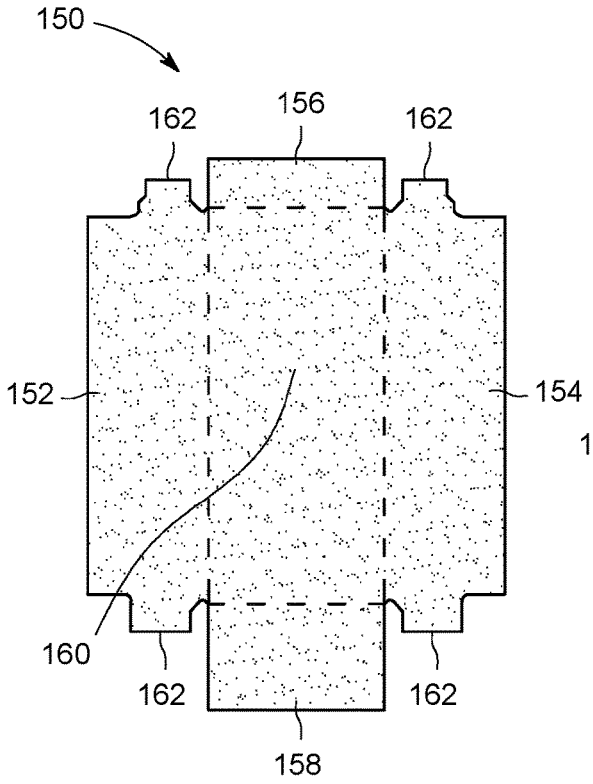
FIG. 2 is a top view of a wrapper for the inner tray blank.
Figure 2A:
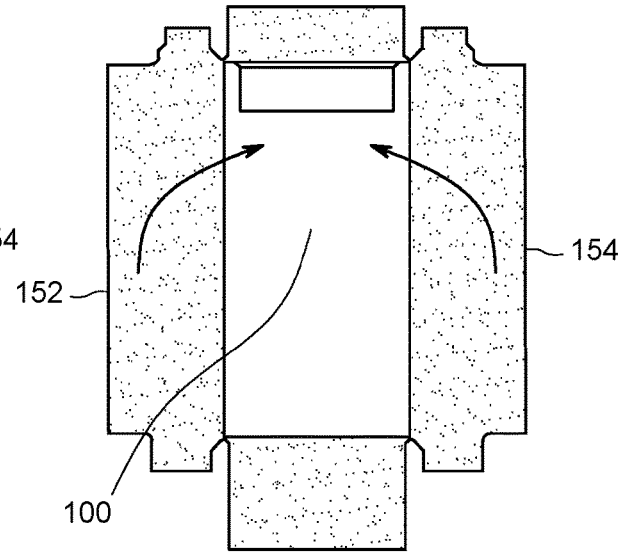
FIG. 2A is a top view of the wrapper with the folded inner tray from FIG. 1D mounted on the wrap.
Figure 2B:
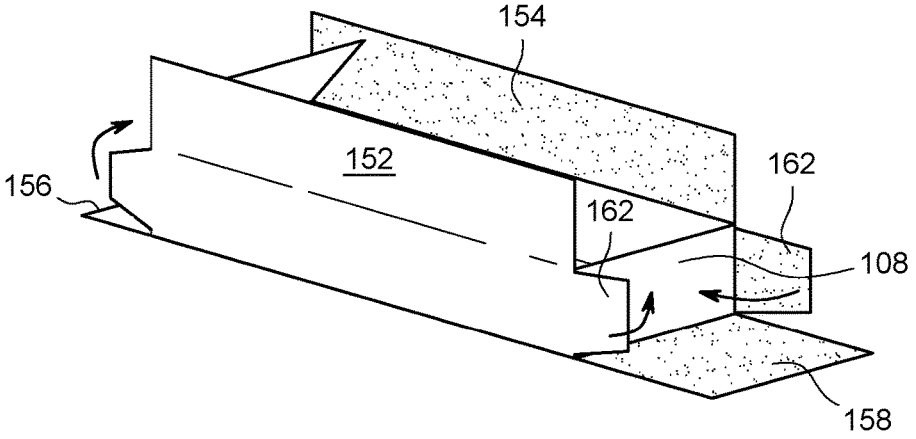
FIG. 2B is a perspective view of the wrapper identifying the first fold step to wrapping the inner tray.
Figure 2C:
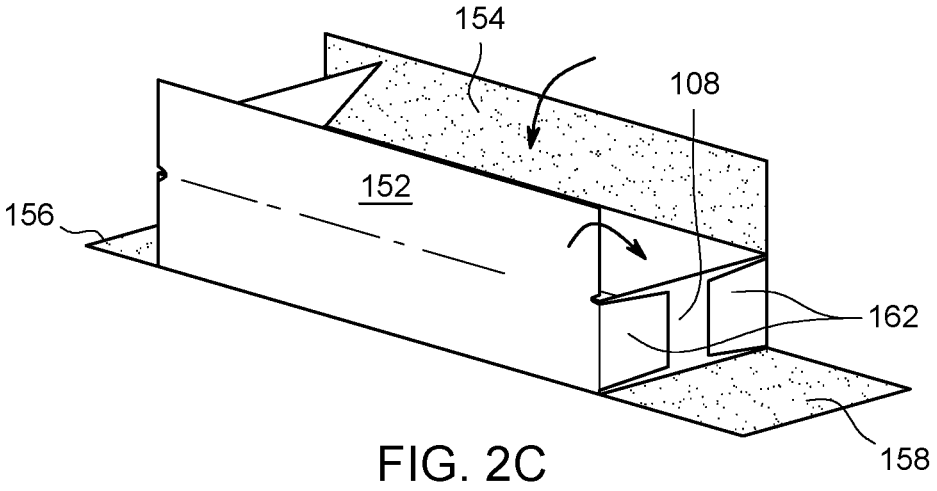
FIG. 2C is a perspective view of the wrapper illustrating completion of the first fold step to wrapping the inner tray and identifying a second fold step to wrapping the inner tray.
Figure 2D:
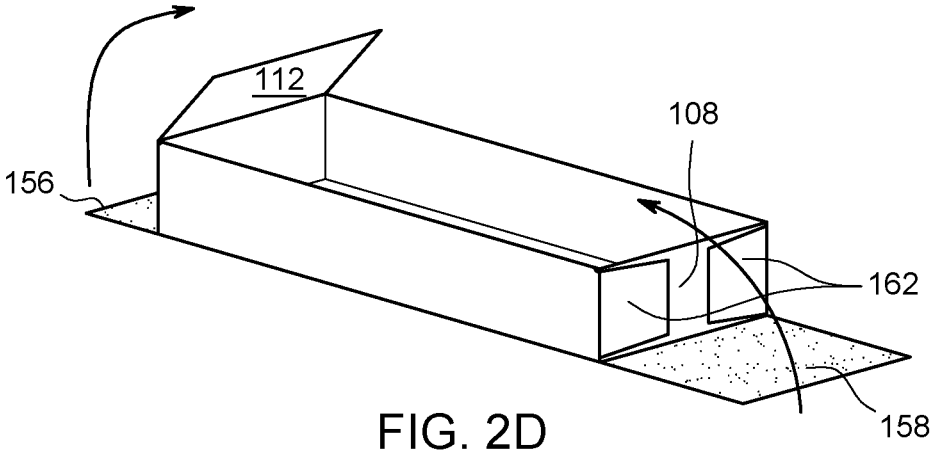
FIG. 2D is a perspective view of the wrapper illustrating completion of the second fold step to wrapping the inner tray and identifying a third fold step to wrapping the inner tray.
Figure 2E:
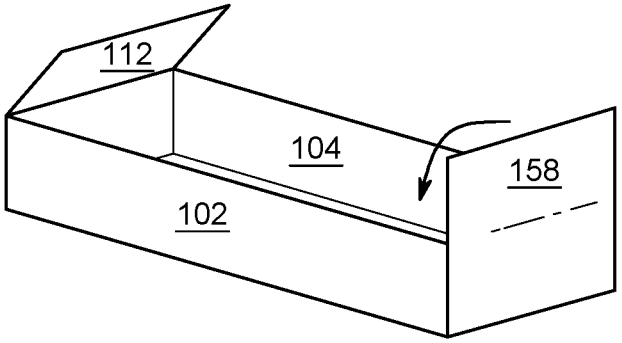
FIG. 2E is a perspective view of the wrapper illustrating completion of the fourth fold step to wrapping the inner tray.
Figure 2F:
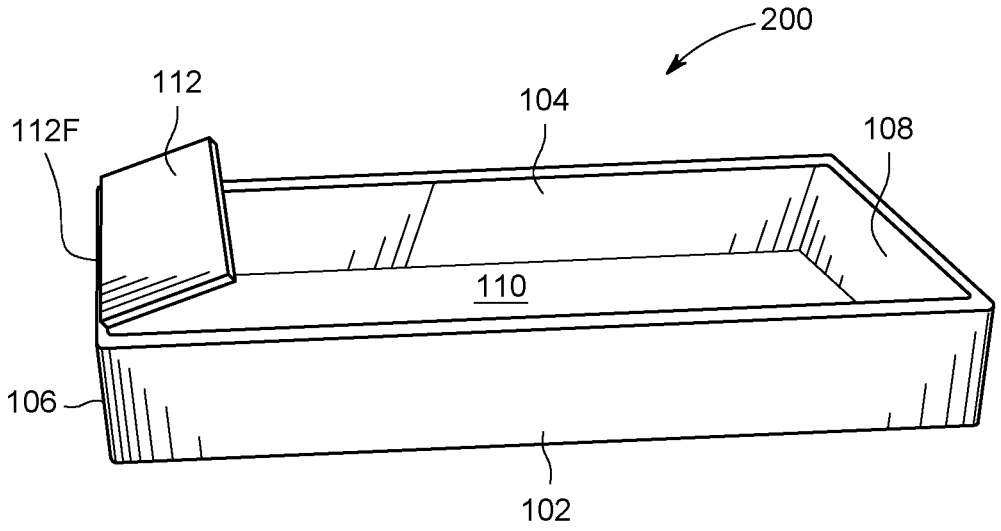
FIG. 2F illustrates the fully assembled and wrapped inner tray.
Figure 3:
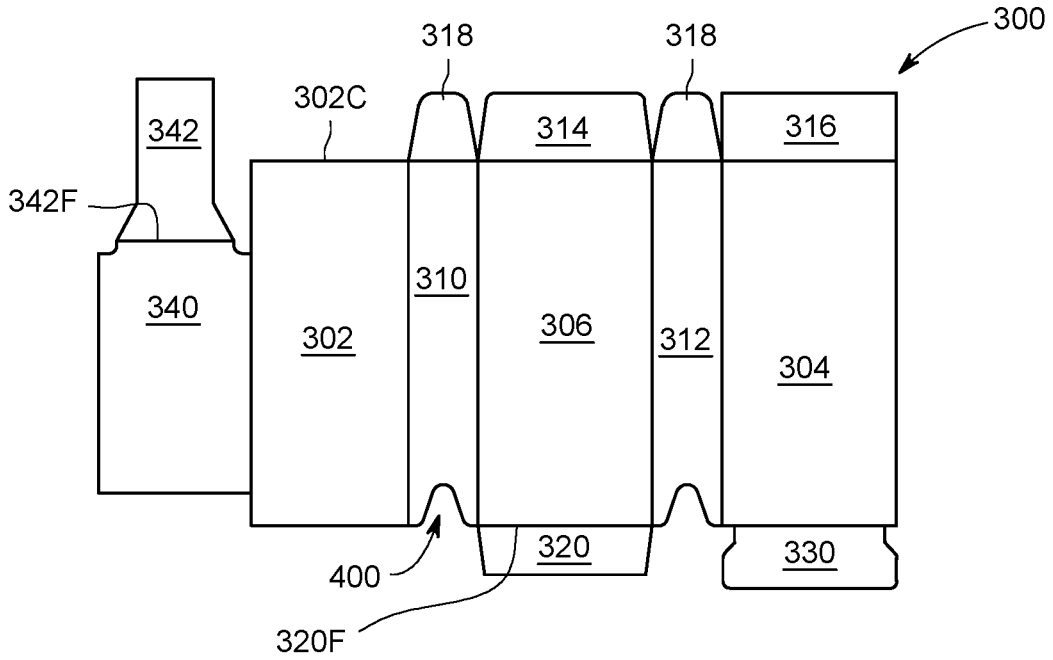
FIG. 3 is a box blank of the outer sleeve, before it is fully assembled.

In one embodiment, the present invention is a paper-based container, not including plastics or other materials. This makes the components of the container machine foldable from carton blanks. FIGS. 1-1D illustrate the carton blank of the inner tray 100 as it is machine assembled. FIGS. 2-2E illustrate the wrapping of the inner tray 100 by wrapper 150. FIG. 2F illustrates the final product of the inner tray 100 and wrapper 150 combined together to form the wrapped inner tray 200. FIGS. 3-3I illustrate the carton blank and assembly of the outer sleeve 300. FIG. 3J shows outer sleeve 300 fully assembled after all folds have been made.

Referring to FIGS. 1-1D, inner tray 100 includes generally square or rectangle side panels 102, 104, end panels 106, 108, bottom panel 110 and a locking tab 112 which are separated by corresponding score cuts 102F, 104F, 106F and 108F. When the inner tray blank is folded, panel 110 forms the bottom of the inner tray, side panels 102, 104 form the sides and end panels 106 and 108 the ends of the inner tray. Locking tab 112 constitutes an engagement flap that forms part of the locking mechanism with the outer sleeve 300. In one embodiment, the inner tray is made of paper board within a range of 40-point to 100-point thickness and a wrapper 150 thickness in a range of 4 to 9 point. However, any range of thickness of paper board used to construct the inner tray, that provides the desired resiliency for the locking tab and sturdiness of the inner tray are anticipated by the present invention.

Machine assembly of the inner panel involves several folding steps. As shown in FIGS. 1A-1B, side panels 102, 104 are first folded 90 degrees to be perpendicular to bottom panel 110. End panels 106, 108 are then folded 90 degrees to be perpendicular to the bottom panel 110 (FIG. 1C). The adjoining ends of the side panels and end panels are then secured together by tape or other suitable means. As shown in FIG. 4, locking tab 112 extends from the top of a first end 280 of the inner tray. Locking tab 112 is then folded along score cut 112F at an angle generally less than 90 degrees to the plane of the end panel 106, as shown in FIG. 2F, its biased position. Locking tab 112 can flex downward from its biased position.

Importantly, as best shown in FIGS. 9A-15, the cardboard of the inner tray is resilient. Score cutting the inner tray blank at 112F allows the locking tab 112 to retain some bias to remain in its original, unscored orientation (before it was folded). Thus, the locking tab 112, and particularly, an engagement edge 114 (FIG. 11) of the locking tab 112, tends to be biased upward against the ceiling of the interior of the outer sleeve 300.

In one embodiment, the outer wrapper ("wrapper") 150, generally shown in FIG. 2, is used to secure the inner tray sides in position and to strengthen the inner tray 100. Adhesive is placed on select surfaces of wrapper 150 that engage the inner tray panels, as shown in FIG. 2). In other embodiments, wrapper 150 may not be needed.

Wrapper 150 includes side panels 152, 154, end panels 156, 158, bottom panel 160 and corner tabs 162. For the purpose of best illustrating the invention, dashed lines were added to FIG. 2 to better identify the bottom panel 160 portion of the wrapper 150. These dashed lines also indicate fold lines on the wrapper 150. To wrap the inner tray 100, the adhesive is applied to one surface of the wrapper. After inner tray 100 is folded as shown in FIG. 1D, it is centered and secured ("spotted") to the bottom panel 160 of the wrap as shown in FIG. 2A. Side panels 152, 154 are folded substantially perpendicular to bottom panel 160 and attached to side panels 102, 104, respectively, of the inner tray, as shown in FIG. 2B. Corner tabs 162 are then secured at the respective corners of the inner tray 100, as shown in FIGS. 2B and 2C. Finally end panels 156, 158 are folded substantially perpendicular to bottom panel 160 and attach to the end panels 106, 108 respectively, as shown in FIG. 2B. The fully wrapped inner tray is shown in FIG. 2F.

The outer sleeve blank 300 is generally shown in FIG. 3. In one preferred embodiment, outer sleeve 300 is made of a flexible cardboard. Outer sleeve 300 includes an inner top panel 302, outer top panel 304, bottom panel 306, side panels 310, 312, end panels 314 and 316, corner tabs 318, open end engagement panel 320, stop tab 330, lock panel 340 and engagement flap 342.

Figure 3A:
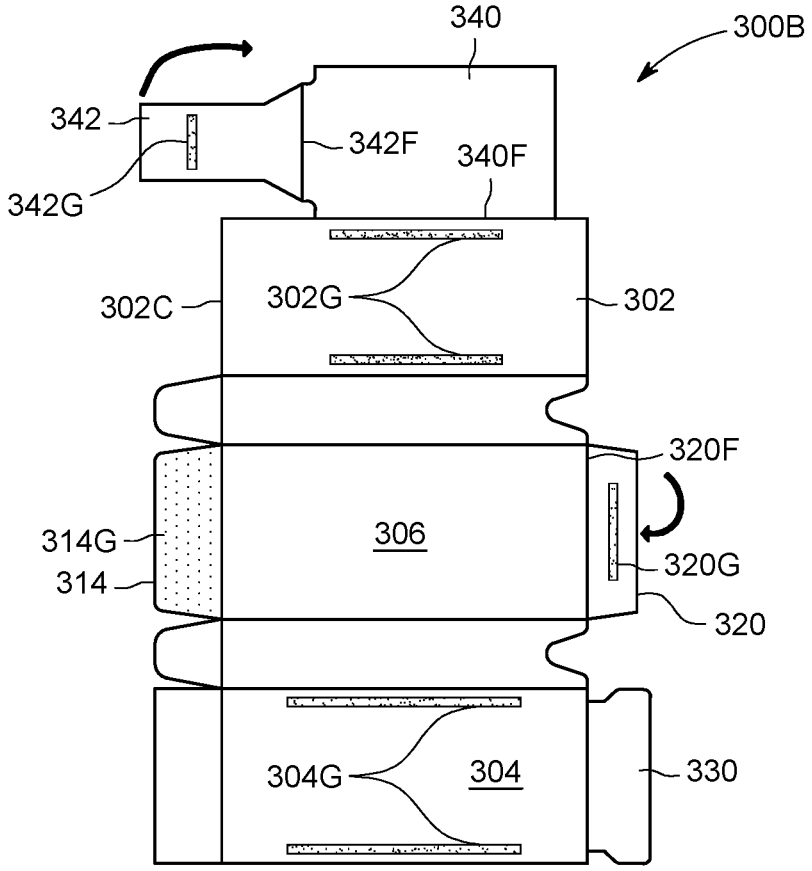
FIG. 3A is a top view of the outer sleeve identifying the first fold steps to assembling the outer sleeve.

As shown in FIG. 3A, a back side 300B of outer sleeve blank 300 includes selectively placed glue or glue strips, including glue strip 342G on the back side of engagement flap 342; glue strips 302G on the back side of panel 302; glue 314G on the back side of panel 314, glue strip 320G on the back side of open end engagement panel 320 and glue strips 304G on the back side of top panel 304. This glue or glue strips are used to hold the outer sleeve together when assembled.

In one embodiment, the outer sleeve is a folding carton made of 18 to 30-point paper folding board. However, any range of thickness of paper board used to construct the outer sleeve that provides the desired characteristics, is anticipated by the present invention.

In one embodiment for use with *cannabis*, the outer sleeve has a blank size 10.3 inches×6.5 inches and a flat foldable size of 3.15 inches×6.625 inches and an assembled sleeve size is 2.25 inches×4.7 inches×0.85 inches. In one embodiment, the outer dimension of the outer sleeve is 4.5 inches× 2.25 inches×0.75 inches with a 0.75-inch locking tab.

The steps in assembling the outer sleeve are shown in FIGS. 3A-3I. Initially, engagement flap 342 is folded over, along score cut 342F, and secured to panel 340 by adhesive strip 342G. This forms a double thick engagement edge along score cut 342F. At the same time, open end engagement panel 320 is folded over, along score cut 320F, and secured to panel 306 by adhesive strip 320G. This forms an engagement edge along score cut 320F to provide stronger support at an open end of the outer sleeve.

Figure 3B:
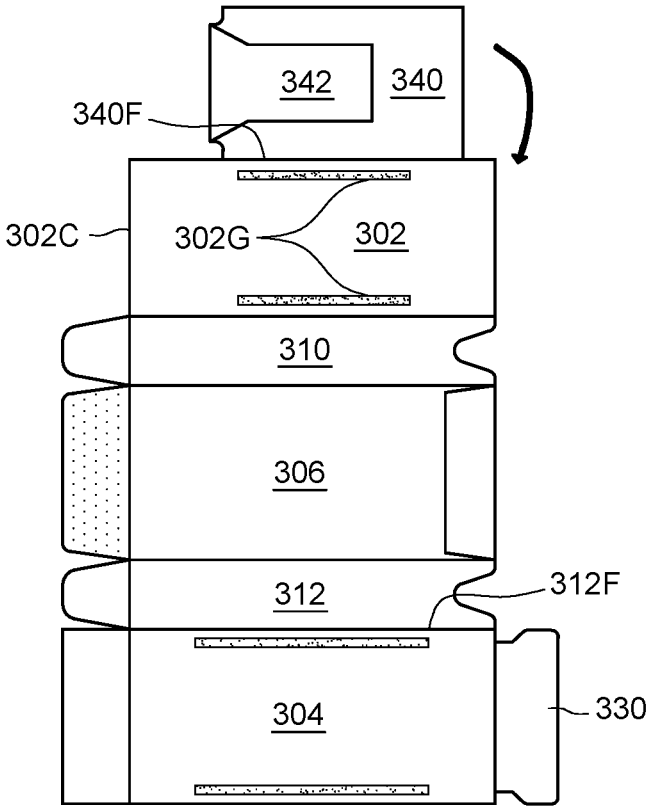
FIG. 3B is a top view of the outer sleeve blank illustrating completion of the first fold steps to assembling the outer sleeve and identifying a second fold step to assembling the outer sleeve.

As shown in FIG. 3B, the combined panels 340/342 are folded over, along score cut 340F, and secured to panel 302 by adhesive strips 302G. Panel 340 is shorter and offset from end 302C of panel 302. When engagement flap 342 is folded over and secured to panel 340, an engagement edge is defined along score cut 342F that forms part of the lock mechanism to keep the wrapped inner tray 200 locked within the outer sleeve 300.

Figure 3C:
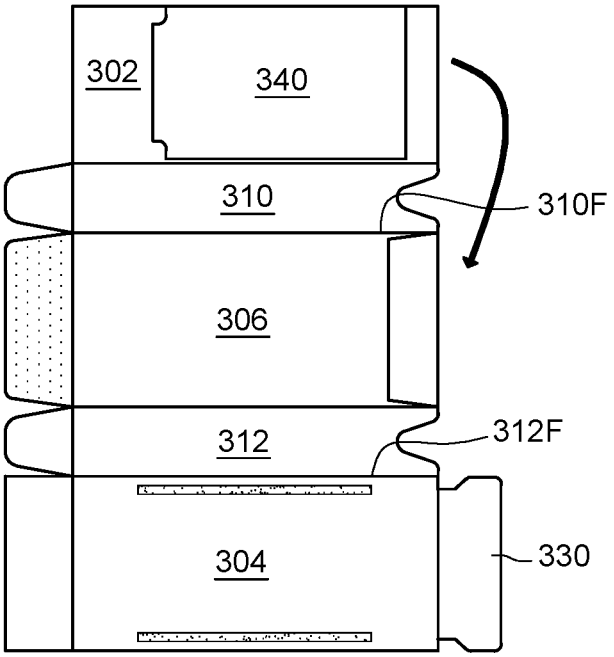
FIG. 3C is a top view of the outer sleeve blank illustrating completion of the second fold steps to assembling the outer sleeve and identifying a third fold step to assembling the outer sleeve.
Figure 3D:
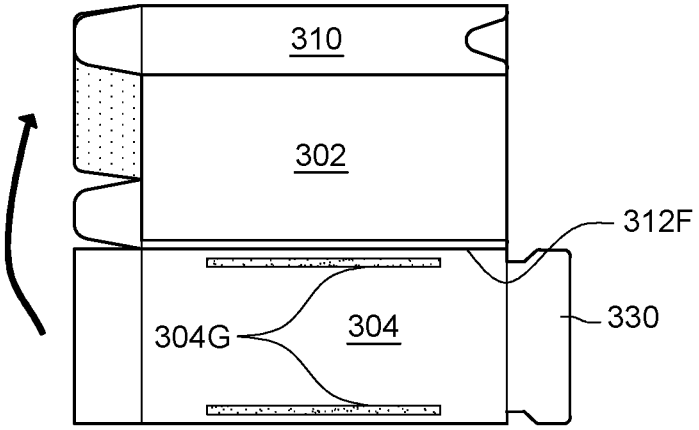
FIG. 3D is a top view of the outer sleeve blank illustrating completion of the third fold steps to assembling the outer sleeve and identifying a fourth fold step to assembling the outer sleeve.
Figure 3E:
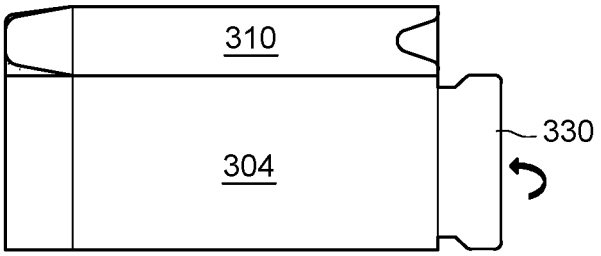
FIG. 3E is a top view of the outer sleeve blank illustrating completion of the fourth fold steps to assembling the outer sleeve and identifying a fifth fold step to assembling the outer sleeve.
Figure 3F:
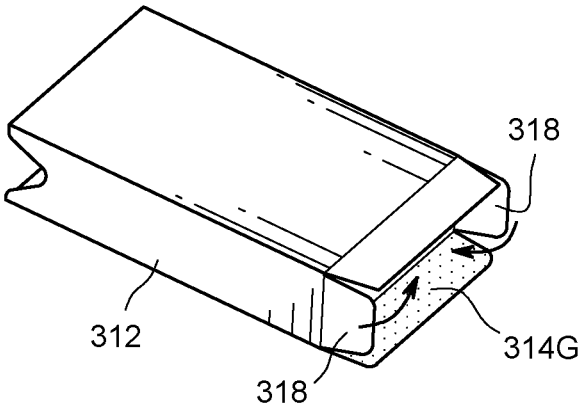
FIG. 3F is a top view of the outer sleeve blank illustrating completion of the fifth fold steps to assembling the outer sleeve and identifying a sixth fold step to assembling the outer sleeve.

As shown in FIG. 3C, the combined panels 340/342 and 310 are then folded over, along score cut 310F, onto panel 306 and side panel 312, resulting in what is shown at FIG. 3D. Panel 304 is then folded over, along score cut 312F, and secured to panel 302 by adhesive strips 304G as shown in FIG. 3E. Sides 310 and 312 are then rotated 90 degrees to open the folded blank into the assembled outer sleeve (FIG. 3F). Stop tab 330 is score cut and folded at an angle into the interior of the outer sleeve 300, as shown in FIG. 3F.

In one embodiment, shown in FIGS. 9B, 13B, 14A and 14B, the combination of the score cut and resilience of the material of which the outer sleeve 300 is composed can bias the stop tab 330 back towards or against panel 302 as shown. In another embodiment shown in FIGS. 9A, 13A and 15, the stop tab 330 extends at a greater angle into the interior of the outer sleeve 300, in one embodiment, closer to 45 degrees to the plane of panel 304. The way in which the locking tab and stop tab engage each other are different in these two embodiments.

Figure 3G:
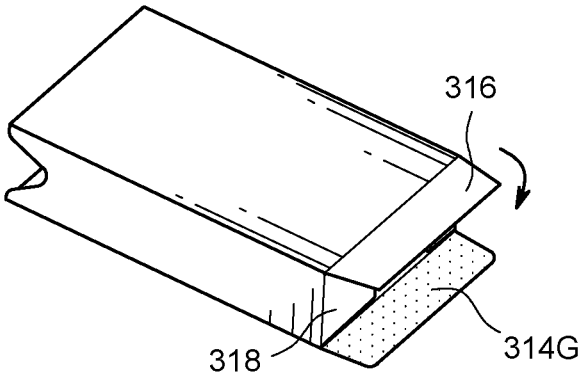
FIG. 3G is a top view of the outer sleeve blank illustrating completion of the sixth fold steps to assembling the outer sleeve and identifying a seventh fold step to assembling the outer sleeve.
Figure 3H:
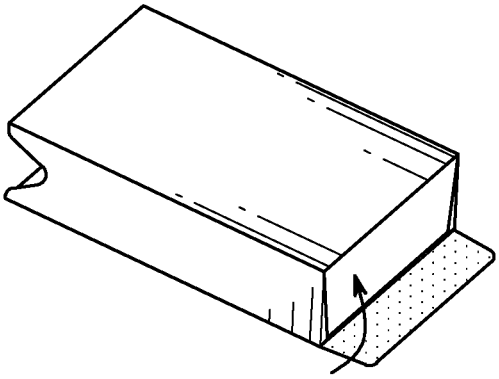
FIG. 3H is a top view of the outer sleeve blank illustrating completion of the seventh fold steps to assembling the outer sleeve and identifying an eighth fold step to assembling the outer sleeve.
Figure 3I:
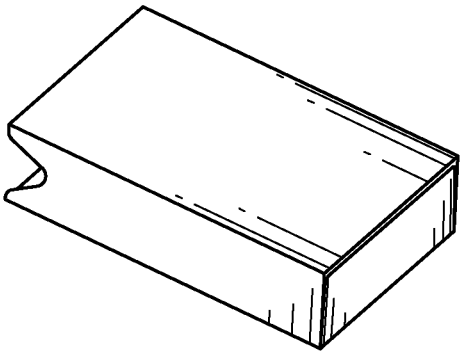
FIG. 3I is a top view of the outer sleeve blank illustrating completion of the eighth fold step to assembling the outer sleeve.
Figure 3J:
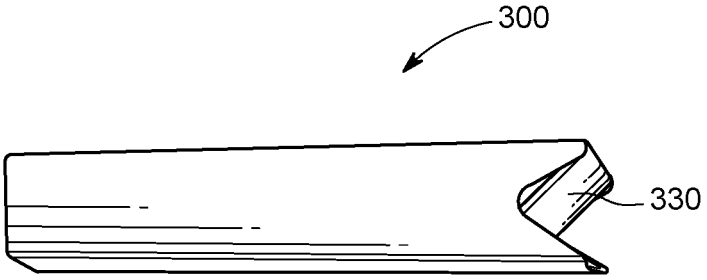
FIG. 3J is a perspective view of the fully assembled outer sleeve.

The corner/side tabs 318 are rotated 90 degrees to partially close the opening formed at that end of the outer sleeve (FIG. 3G). Next, end flap 316 is rotated 90 degrees into the corner flaps 318 (FIG. 3H); end flap 314 is then rotated 90 degrees into engagement with end flap 316 and secured thereto by adhesive 314G to form a closed end 360 of the outer sleeve as shown in FIG. 3I.

As shown in FIG. 4, when outer sleeve is fully assembled, it has an open end 350 and a closed end 360. At the open end 350, the side panels 310, 312 have concave edges 400, making it easier to grasp the wrapped inner tray 200 to slide it open.

When the first end 280 of the wrapped inner tray 200 is slidably inserted into the open end 350 of the outer sleeve 300, locking tab 112 can slide past the stop tab 330 (FIGS. 9A and 9B) of the outer sleeve 300. However, once locking tab 112 slides past the stop tab 330, if the wrapped inner tray 200 is withdrawn from the outer sleeve 300, locking tab 112 will engage the stop tab 330, preventing the wrapped inner tray from being fully removed from the outer sleeve 300, as shown in FIGS. 14A, 14B and 15.

Figure 13A:
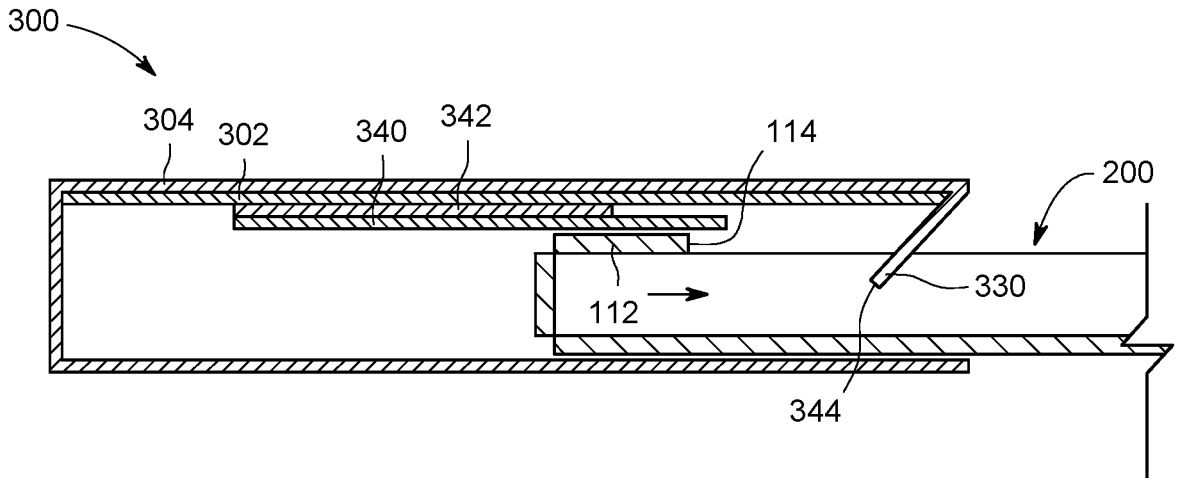
FIG. 13A is a partial sectional view of the wrapped inner tray mounted within the outer sleeve with the lock mechanism in the unlocked position, illustrating a first embodiment of the outer sleeve stop mechanism.
Figure 13B:
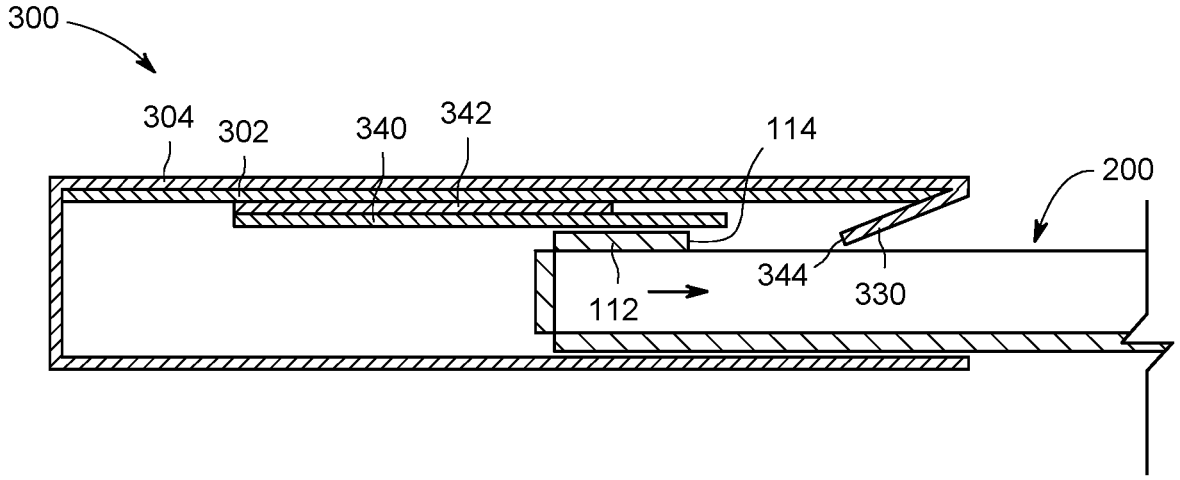
FIG. 13B is a partial sectional view of the wrapped inner tray mounted within the outer sleeve with the lock mechanism in the unlocked position, illustrating a second embodiment of the outer sleeve stop mechanism.
Figure 14A:
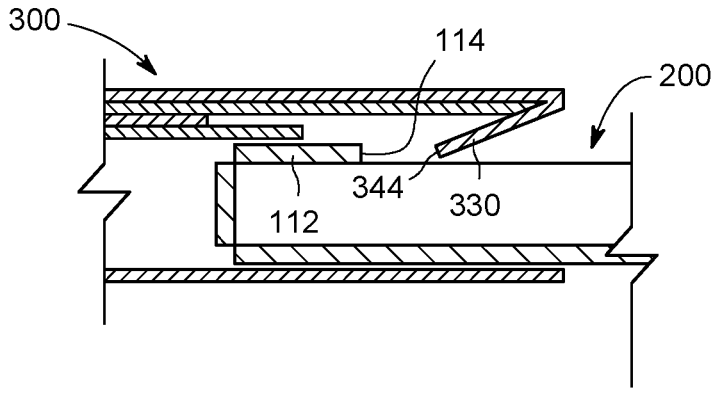
FIG. 14A is a partial sectional view of the wrapped inner tray mounted within the outer sleeve with the lock mechanism in the unlocked position, illustrating the second embodiment of the outer sleeve stop mechanism.
Figure 14B:
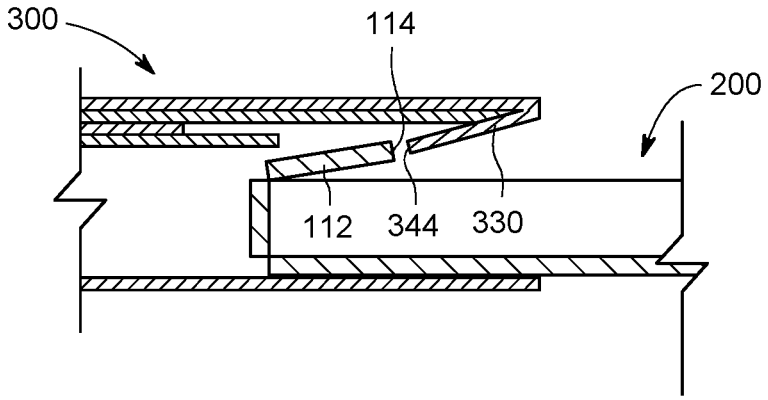
FIG. 14B is a partial sectional view of the wrapped inner tray mounted within the outer sleeve with the lock mechanism in the unlocked position, illustrating the second embodiment of the outer sleeve stop mechanism about to engage the inner tray flap.
Figure 15:
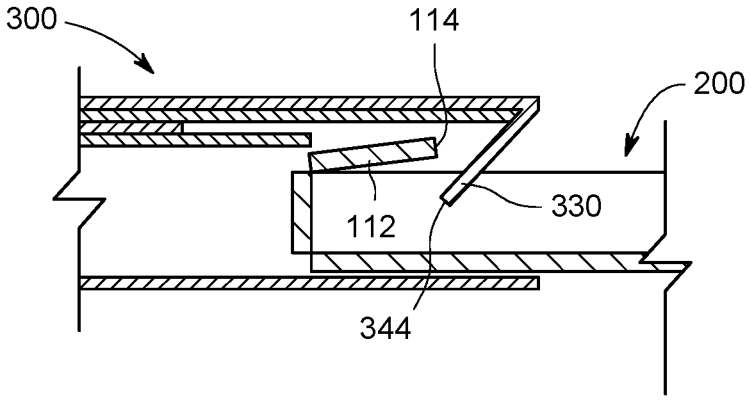
FIG. 15 is a partial sectional view of the wrapped inner tray mounted within the outer sleeve with the lock mechanism in the unlocked position, illustrating the first embodiment of the outer sleeve stop mechanism about to engage the inner tray flap.

In one embodiment, as shown in FIGS. 13B, 14A and 14B, edge 114 of locking tab 112 will abut engagement edge 344 of stop tab 330. In a second embodiment, as shown in FIGS. 13A and 15, edge 114 of locking tab 112 will engage the side of stop tab 330. In either case, the engagement of the stop tab 330 and locking tab 112 prevent the wrapped inner tray 200 from being removed from the outer sleeve 300.

Figure 9A:
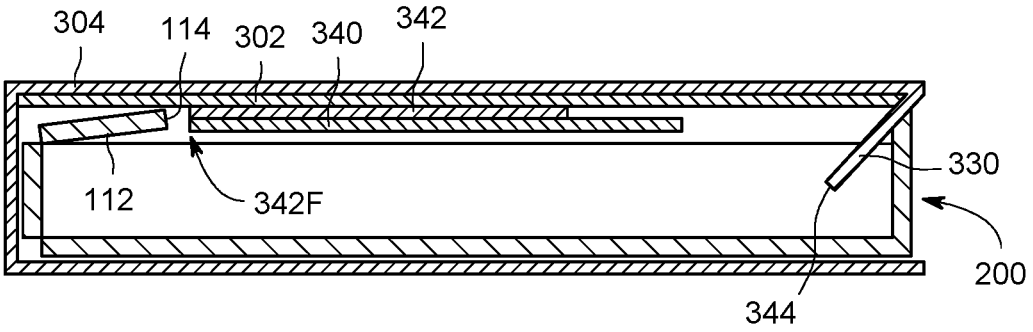
FIG. 9A is a sectional view of a first embodiment of the wrapped inner tray mounted within the outer sleeve in the locked position.
Figure 9B:
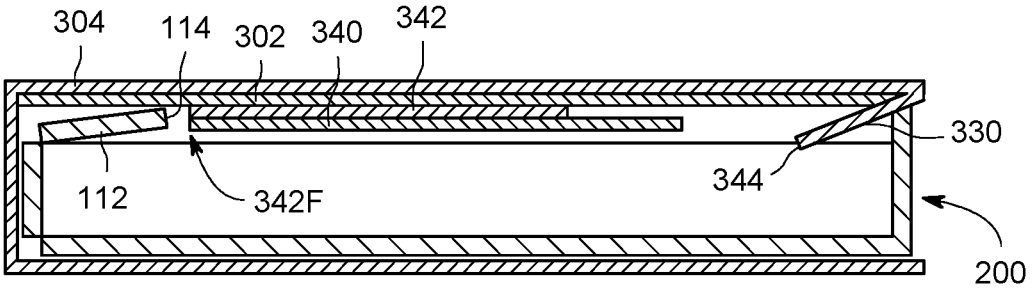
FIG. 9B is a sectional view of a second embodiment of the wrapped inner tray mounted within the outer sleeve in the locked position.
Figure 10:
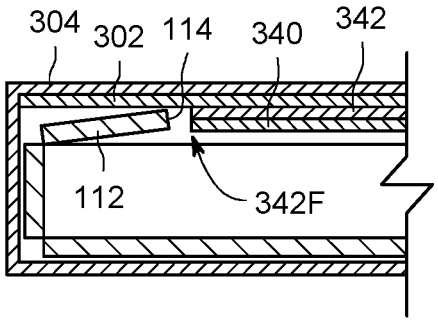
FIG. 10 is a partial sectional view of the wrapped inner tray mounted within the outer sleeve in the locked position.

When the wrapped inner tray 200 is fully slid into the outer sleeve 300, as shown in FIGS. 9A, 9B and 10, locking tab 112 of the wrapped inner tray 200 is biased upwards into the ceiling of the outer sleeve's 300 interior due to the resiliency of the inner tray's 200 material and the partial score cut along score cut line 112F. The unique size and shape of panels 342, 340 and 302 create a space between the closed end 360 of the outer sleeve 300 and the engagement edge 342F for receiving the locking tab 112. In this orientation, the leading edge 114 of locking tab 112 faces and engages engagement edge created by the 342F score cut and folding of panels 342 and 340. In this orientation, the wrapped inner tray 200 is locked into its closed position within the outer sleeve 300, and cannot be slid to its open position, substantially extending out of the outer sleeve 300.

Near the closed end of the outer sleeve 300, on the top panel of the outer sleeve 300, is a pinch point 370. The pinch point is strategically located so that when pressure is applied to the pinch point 370, the cardboard outer sleeve 300 flexes sufficiently to engage locking tab 112 of the wrapped inner tray 200 when the wrapped inner tray 200 is in its locked position, fully housed within the outer sleeve 300.

Figure 11:
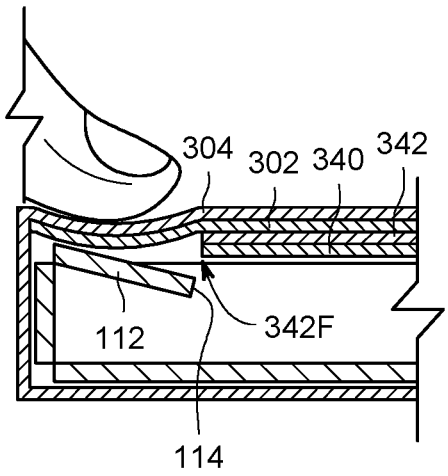
FIG. 11 is a partial sectional view of the wrapped inner tray mounted within the outer sleeve with the lock mechanism in the unlocked position.
Figure 12:
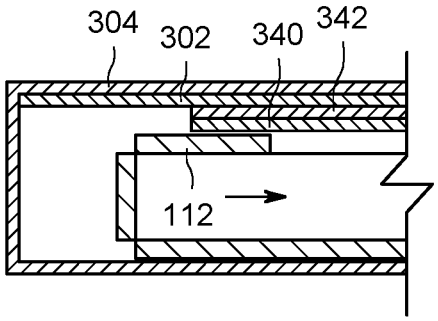
FIG. 12 is a partial sectional view of the wrapped inner tray mounted within the outer sleeve with the lock mechanism in the unlocked position and the wrapped inner tray partially withdrawn from the outer sleeve.

To unlock the lock mechanism so that the wrapped inner tray 200 may be slid open and the contents of the wrapped inner tray 200 retrieved, a force, such as by a person's thumb, is applied to the top panel of the outer sleeve 300 at the pinch point 370. The pressure on the outer top panel 304 of the outer sleeve 300 causes the inner top panel 302 to engage locking tab 112, pushing it downward. Downward motion of locking tab 112 disengages the leading edge 114 of locking tab 114 from the engagement edge 342F of the outer sleeve 300. The wrapped inner tray 200 can then be slid open, as shown in FIGS. 11, 12 and 13, until it is stopped by the stop tab 330.

Although described as a wrapped inner tray 200, the tray utilized in the present invention can be constructed in any manner, provided it includes a locking tab 112 oriented as described herein.

In another embodiment, stop tab 330 contains laterally extending ears (not shown). The width of the stop tab (between ears—not shown) is wider than the distance between sides 102, 104 of inner tray 100 when fully assembled. This allows the stop tab 330 to "ride" on top of the sides of the inner tray 100 when mounted within the outer sleeve 300. In this manner, the engagement edge 344 of stop tab 330 is oriented to contact the engagement edge 114 of locking tab 112, edge to edge.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in several orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A child resistant container including the following:

a. an inner tray having a floor, two sides, a back panel, a front panel and an open top, a locking tab pivotally attached by a first end to a top of the back panel, the locking tab having an engagement edge on a second end opposite the first end, the locking tab being biased so the engagement edge is positioned at or above the top of the back panel;

b. an outer sleeve having a floor, ceiling, two sides, a back panel and an open front to define a space for receiving the inner tray, an engagement edge located on the ceiling to engage the locking tab engagement edge when the inner tray is in a closed position, fully inserted into the outer sleeve, and a pinch point on the ceiling of the outer sleeve for applying pressure to the inner tray locking tab;

c. wherein, when the inner tray is in its closed position, the locking tab is biased so that the engagement edge of the locking tab engages the outer sleeve engagement edge to lock the inner tray in the outer sleeve, and when pressure is applied to the pinch point, the locking tab is rotated out of engagement with the outer sleeve engagement edge, allowing the inner tray to be removed from the outer sleeve.

2. The child resistant container of claim 1 wherein the inner tray is made of cardboard having a thickness in the range of 40-point to 100-point.

3. The child resistant container of claim 1 wherein the inner tray is made of cardboard having a thickness of 80-point.

4. The child resistant container of claim 1 wherein the outer sleeve includes a stop tab pivotally attached by a first end to a front edge of the ceiling, the stop tab being biased to extend into the outer sleeve in the direction of the back panel to engage the locking tab of the inner tray and prevent the inner tray from being entirely removed from the outer sleeve.

5. The child resistant container of claim 1 wherein the outer sleeve is made of cardboard having a thickness in the range of 18-point to 30-point.

6. The child resistant container of claim 1 wherein the outer sleeve is made of cardboard having a thickness of 24-point.

7. The child resistant container of claim 1 wherein the sides of the outer sleeve, at the front opening of the outer sleeve, have edges that are concave to make it easier to grasp the inner tray.

8. The child resistant container of claim 1 wherein the outer sleeve includes a stop tab pivotally attached by a first end to a front edge of the ceiling, the stop tab having a second end, opposite the first end, defining an engagement edge, the stop tab being biased to extend into the outer sleeve in the direction of the back panel, wherein the stop tab is wider than the width of the inner tray, so that the stop tab engagement edge rides on top of the inner tray sides to engage the locking tab engagement edge as the inner tray is being withdrawn from the outer sleeve.

9. A child resistant container including the following:

a. an inner tray having a floor, two sides, a back panel, a front panel and an open top, a locking tab pivotally attached by a first end to a top of the back panel, the locking tab having an engagement edge on a second end opposite the first end, the locking tab being biased so the engagement edge is positioned at or above the top of the back panel;

b. an outer sleeve having a floor, ceiling, two sides, a back panel and an open front to define a space for receiving the inner tray, a stop tab pivotally attached by a first end to a front edge of the ceiling, the stop tab having a second end, opposite the first end, defining an engagement edge, the stop tab being biased to extend into the outer sleeve in the direction of the back panel, wherein the stop tab is wider than the width of the inner tray, so that the stop tab engagement edge rides on top of the inner tray sides to engage the locking tab engagement edge as the inner tray is being withdrawn from the outer sleeve.

10. A two-piece folding box consisting of the following:

a. An inner tray box blank having a rectangular floor panel, two side panels connected by a first end to and on opposite sides of the floor panel by two folding lines, two end panels connected by a first end to and on opposite ends of the floor panel by two folding lines, and a locking tab panel connected to a second end of one of the end panels by a folding line; and b. An outer sleeve blank having a floor panel, first and second side panels connected by a first end to and on opposite sides of the floor panel by two folding lines, each side panel having an end flap connected to a first end of the side panels by a folding line, two end panels connected by a first end to and on opposite ends of the floor panel by two folding lines, an outer top panel connected to a second side of the first side panel by a folding line, the first outer top panel having end panels connected on opposite ends of the outer panel by folding lines, one of the end panels serving as a stop tab, a first inner top panel connected by a first side to a second side of the second side panel by a folding line, the first inner top panel having a first end; a smaller second top panel connected by a first side to a second side of the first inner top panel by a folding line, and a lock edge panel connected to a first end of the second inner top panel by a folding line, such that the lock edge panel fold line is spaced from the first end of the first inner top panel.

11. The folding box of claim 10 wherein the folding lines are score cut lines.

12. The folding box of claim 10 wherein the inner tray box blank is made from cardboard having a thickness in the range of 60-point to 100-point.

13. The folding box of claim 10 wherein the outer sleeve is made from cardboard having a thickness in the range of 18-point to 30-point.

14. The folding box of claim 10 wherein the side panels have a second concave end.

15. The folding box of claim 10 further including a wrapper for encasing the inner tray, the wrapper including a floor panel, first and second end panels connected to and on opposite ends of the floor panel, first and second side panels connected by a first end to and on opposite sides of the floor panel, each side panel having end flaps connected to and on opposite ends of the side panels.

16. The folding box of claim 10 where in the floor panel side flaps and end flaps are larger than the inner tray side and end panels.

* * * * *